US008844334B2

(12) United States Patent
Roeterdink

(10) Patent No.: US 8,844,334 B2
(45) Date of Patent: Sep. 30, 2014

(54) METHOD AND APPARATUS FOR FORMING A STEEL PRESSURE CONTAINER, SUCH STEEL PRESSURE CONTAINER AND A PREFORM THEREFOR

(75) Inventor: Johan Willem Roeterdink, Epse (NL)

(73) Assignee: Impress Group B.V., Deventer (NL)

( * ) Notice: Subject to any disclaimer, the term of this patent is extended or adjusted under 35 U.S.C. 154(b) by 1030 days.

(21) Appl. No.: 12/375,093

(22) PCT Filed: Jul. 16, 2007

(86) PCT No.: PCT/EP2007/006358

§ 371 (c)(1),
(2), (4) Date: Nov. 23, 2009

(87) PCT Pub. No.: WO2008/012015

PCT Pub. Date: Jan. 31, 2008

(65) Prior Publication Data

US 2010/0129679 A1 May 27, 2010

(30) Foreign Application Priority Data

Jul. 26, 2006 (EP) ..... 06076483

(51) Int. Cl.

| | |
|---|---|
| ***B21D 11/00*** | (2006.01) |
| ***B21D 51/28*** | (2006.01) |
| ***B21D 51/26*** | (2006.01) |
| ***B65D 83/38*** | (2006.01) |
| ***B21D 51/24*** | (2006.01) |
| ***B21D 22/21*** | (2006.01) |

(52) U.S. Cl.

CPC ..... *B21D 51/2615* (2013.01); *B65D 83/38* (2013.01); *B21D 51/24* (2013.01); *B21D 22/21* (2013.01)

USPC ..... 72/379.4; 413/69

(58) Field of Classification Search

CPC ..... B21D 22/22; B21D 22/28; B21D 22/30; B21D 51/26; B21D 52/2615; B21D 51/2623

USPC ..... 72/347–349, 379.4; 413/69

See application file for complete search history.

(56) References Cited

U.S. PATENT DOCUMENTS

| | | | | |
|---|---|---|---|---|
| 2,339,763 | A | | 1/1944 | Calleson et al. |
| 2,535,839 | A | | 12/1950 | Coyle et al. |
| 3,029,507 | A | | 4/1962 | Gaggini |
| 3,682,122 | A | * | 8/1972 | Haddon et al. ..... 72/348 |
| 3,818,850 | A | | 6/1974 | Berthet |
| 4,369,643 | A | * | 1/1983 | Cianciolo et al. ..... 72/75 |
| 4,446,714 | A | * | 5/1984 | Cvacho ..... 72/370.02 |
| 4,711,611 | A | | 12/1987 | Bachmann et al. |
| 6,006,933 | A | * | 12/1999 | Henning et al. ..... 215/328 |
| 6,305,210 | B1 | | 10/2001 | Saunders et al. |

FOREIGN PATENT DOCUMENTS

| | | |
|---|---|---|
| EP | 0 530 383 A1 | 3/1993 |
| GB | 2 216 052 A | 10/1989 |

* cited by examiner

*Primary Examiner* — Teresa M Ekiert
(74) *Attorney, Agent, or Firm* — The Webb Law Firm

(57) ABSTRACT

The invention relates to a method for forming a steel container having a curled open end, comprising the steps of i) providing a steel cup; ii) deep drawing the steel cup into a drawn container preform; iii) thin drawing the body of the drawn container preform; and iv) curling an open end of the drawn container preform by forming a precurl and by curling the precurl into an elongated curl, to an apparatus for forming a steel container, and to such steel container and its preform.

23 Claims, 20 Drawing Sheets

METHOD AND APPARATUS FOR FORMING A STEEL PRESSURE CONTAINER, SUCH STEEL PRESSURE CONTAINER AND A PREFORM THEREFOR

BACKGROUND OF THE INVENTION

1) Field of the Invention

The present invention relates to a method and apparatus for forming a steel container, to such steel container and a steel container preform therefore and further to a container provided at its open end with a dispensing unit or closure.

These containers may be used as pressure container for instance for dispensing aerosols, foodstuff such as dressings, sweet smelling gas mixtures and the like. The pressure in such a pressure container may range from 1-30 bar, in particular 10-20 bar. Such pressure containers are normally made from aluminum.

2) Brief Description of the Prior Art

Presently, there is a tendency for using steel instead of aluminum. The production of containers made of steel is problematic. For reasons that the container is to made starting from a steel cup or steel plate. The steel cup is to be formed in a container preform and provided with a curl and optionally a necked free end into which the curl is formed. Onto this curl a closure or dispensing unit is to clenched. All these manipulations starting from steel plate or a steel cup require that the metal is suitable for being subjected to forming operations resulting in a thinning of the wall of the steel cup and further radial expansion and reduction of diameter during the curling and/or necking operations.

SUMMARY OF THE INVENTION

The present invention has for its object to provide a method for forming a steel container, such as a pressure container, which container complies with the requirements for the container and container preform in relation to formation at low variations in dimensions, failure of steel material or forming tools, and finally to the requirement that the steel containers should be produced at a reasonable speed such as 500-2000 steel containers per minute.

According to a first aspect of the present invention is provided a method for forming a steel container, such as a pressure container, having a curled open end, comprising the steps of:

i) providing a steel cup;

ii) deep drawing the steel cup into a drawn container preform;

iii) thin drawing the body of the drawn container preform; and iv) curling an open end of the drawn container preform by forming a precurl and by curling the precurl into an elongated curl.

The method according to the invention comprises two critical forming operations being deep drawing and subsequently thin drawing. In the deep drawing operation the container preform is formed at an increasing cup height, a decreasing cup diameter, and decreasing body thickness. The container preform formed after deep drawing is not suitable for a subsequent curling operation during which the open end of the drawn container is curled. The steel material fails due to the formation of cracks and irregular curls with a high variation in curl dimensions. However, if the deep drawn container preform is first thin drawn prior to curling then the above described curling problems are overcome. The invention is based on the insight that after deep drawing the body of the drawn container preform is not of the same material thickness over the height of the drawn container perform body. Starting from the bottom of the drawn container preform the thickness of the body wall increases towards the open end. If by thin drawing the wall thickness of the body in at least the open end (which will be subject to the curling operation) is reduced and provided with a substantially constant wall thickness then curling of this thin drawn open end results in curls of good quality.

According to preferred embodiment the steel cup used in the deep drawing operation is formed from steel plate preferably by (deep) drawing.

This deep drawing operation is preferably carried out in several deep drawing steps. During these deep drawing steps the diameter of the body wall is gradually decreased whereas at the same time the height of the cup is gradually increased. The body of the cup may have the same or a slightly reduced thickness relative to the original steel plate out of which the steel cup is formed. Depending on the dimensions of the drawn container preform the number of deep drawing steps is about 2-6 deep drawing steps such as 3 deep drawing steps.

Generally, a container is provided with a concave bottom which increases the strength of the container particularly at (higher) pressures which may result in the use of containers having a thinner bottom (thus starting from a thinner steel plate). The concave bottom may be formed in the container preform during or after the deep drawing operation. The drawn container preform has an irregular free edge which may interfere with subsequent forming operations. This irregular free end is preferably removed by trimming and more preferably by punch trimming.

The drawn container preform having being subjected by deep drawing and thin drawing of the body could now be made subject of the curling operation during which first a precurl is formed and subsequently the precurl is formed into an elongated curl. The curl should have substantial constant dimensions for reasons that on to this curl the closure or dispensing unit is to be clinched during which a gastight closure is to be formed.

According to a preferred embodiment a free end zone of the drawn container preform is necked such that the subsequently formed curl resides within an imaginary envelope of the container body. In other words the outer diameter of the curl is smaller than the diameter of the body of the container according to the invention. The free end zone is thereto subjected to a necking operation preferably in the form of several necking steps which may amount in total 2 to 10 necking steps, such as 3-7 necking steps, such as 5 or 6 necking steps. The necking whereby the diameter is reduced requires an inward movement of end zone material. In order to control as much as possible this inward movement of the end zone during its necking it is preferred that at least one necking step comprises a mandril necking step. During mandril necking the portion of the end zone under necking operation makes contact with the mandril and supported on the inserted mandril is pushed or drawn through a necking ring. This results in a more reliable necking operation and in a necked portion of lower variation in diameter and thickness and a low number of failures. When the necked free end is to be trimmed classical rotating trim means may be used. However, it is preferred to trim by pinch trimming by the use of an adapted or additional pinch trim mandril.

According to a preferred embodiment the steel used for forming the steel container is coated at at least one side with a coating. Such coating may be a coating avoiding corrosion of the steel or improves its quality, reduces friction or provides good aesthetic appearance. An example of such a coating is PET. The steel may be coated at one side or at both sides and if coated at both sides the coating may have a different thicknesses. The inside of the container may have a thicker coating than the coating on the outside. The coating may have a thickness of 10-100 micrometer, such as 15-40 micrometer, in particular 20-30 micrometer. For example the thickness of the coating at the inner side of the container may be 30 micrometer and at the outside 20 micrometer.

During the deep drawing, thin drawing, necking and curling operations the strengths with which the coating is coated on and adhered to the steel may be insufficient for being subjected to these operations or would result in a rough outer surface. In order to overcome these drawbacks, it is preferred to subject the coating to a heating operation such as a heating at 100-400° C., preferably 150-350° C., such as 200-300° C. These temperatures to be applied are to be determined by routine experimentation in relation to the material of the coating and its thickness. For PET a heat treatment at 280° C. is sufficient for improve the adherence to the steel surface. Heating is preferably carried out by induction heating which allows a local heating of in particular the part of the container which is to be subjected to necking and curling. This preferred heating treatment comprises induction heating. Induction heating has another important advantage being that there is no need for making contact in between a heating element and the preform to be heated. If needed an adapted heating operation may be applied to the coated concave bottom.

Another aspect of the invention relates to an apparatus for forming a steel container. This apparatus according to the invention comprises:

i) an unit for deep drawing a steel cup into a drawn container preform;

ii) an unit for thin drawing the body of the drawn container preform; and iii) an unit for curling an open end of the drawn container preform, which curling unit comprises a precurl forming sub unit and an elongated curl forming sub unit.

The apparatus preferably comprises an unit for forming a steel cup when the steel cup is to be made from steel plate.

In relation to the deep drawing apparatus to be carried out the apparatus comprises a deep drawing unit which has several deep drawing subunits in order to carry out the subsequent deep drawing steps. The number of deep drawing subunits amounts preferably from 2 to 6, such as 3 deep drawing subunits.

According to a preferred embodiment the apparatus comprises an unit for forming a concave bottom in the drawn container preform.

If the container preform is to be trimmed at its free end then the apparatus according to the invention preferably comprises a trimming unit.

If the steel container according to the invention is to be provided with a necked end zone then the apparatus according to the invention comprises a necking unit for necking a free end zone of the drawn container preform, preferably comprising several necking sub units, such as 2-10 necking sub units. In order to carry out the necking unit by mandril necking then the apparatus comprises a mandril necking (sub) unit. As discussed above, a (pinch) trimming unit may be used for trimming the necked free end.

For a preferred heating of the free end zone to be necked of the steel container preform, the apparatus is provided with a heating unit which is preferably an induction heating unit.

Finally, the invention relates to the steel container and steel sure container preform which are formed or formable in the above described method according to the invention and/or in the above described apparatus according to the invention. The container preform and container according to the invention are characterized in that they have been made from steel, preferably coated at one or both sides with a protective or aesthetic coating. The bottom of the container preform and container is thicker than the wall thickness of the body, whereas the body of both the steel container and its preform are substantially constant particularly in the free end zone up to the curl or if available the necked portion. In the necked free end the thickness increases slightly with about 4% for each necking operation step. The curl of the container and container preform of the present invention is characterized by the precurl which is enclosed by an elongated curl and lies against the body or necked body outer wall. If the container or container preform has been subjected to the heating operation and was coated with a protective coating such as PET, then the heated part of the body will have a glossy appearance whereas the other part towards the bottom of the container or container preform is non-glossy.

DETAILED DESCRIPTION OF THE DRAWINGS

Mentioned and other characteristics and features of the method and apparatus for forming a steel container and of the steel container and its preform will be further elucidated in the following description of several embodiments, which description is given for illustrative purposes and is not intended to limit the method, the apparatus, the container and preform according to the invention to any extent. In the description reference will be made to the drawings in which FIG. 1A shows a perspective view of a steel container according to the invention;

DETAILED DESCRIPTION OF THE INVENTION

Figures 1A, 1B, 2:
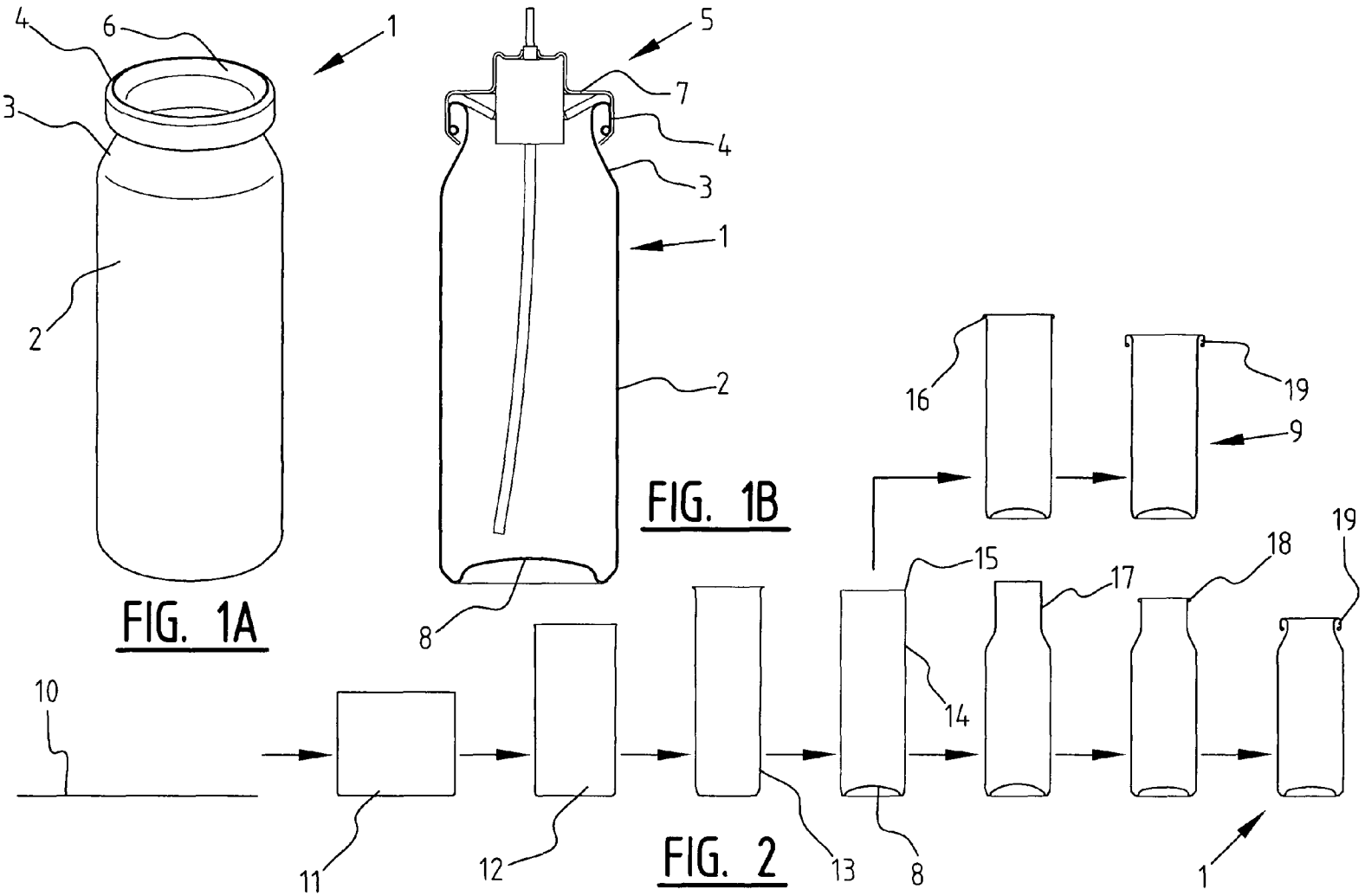
FIG. 1B shows in cross-section this steel container provided with a dispensing unit.
FIG. 2 is a schematic flow diagram of the method according to the present invention resulting in two different steel containers.
Figure 4:
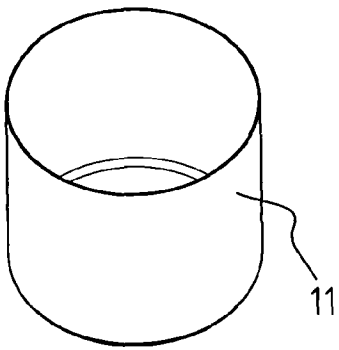
FIG. 4 shows a perspective view at larger scale of the steel cup formed in FIG. 3C.

FIG. 1A shows a container, for instance pressure container 1, made of steel according to the invention. The container 1 comprises a body 2, a necked free end zone 3 and an elongated curl 4.

FIG. 1B shows the container 1 according to the invention in the form of an end product 5 because the open end 6 of the container 1 is closed off by a clinched on dispensing unit 7. FIG. 1B shows further the concave bottom 8.

FIG. 2 shows the various stages of the method according to the invention for the formation of a steel container 1 or 9. A steel plate 10 is deep drawn into a cup 11 and subsequently in a preform 12. The subsequent deep drawn preform 13 is trimmed at the free edge 15 and provided with a concave bottom 18. Following a first embodiment this preform 14 is provided with a precurl 16 at its free end zone and finally with an elongated curl 19 thereby forming the container 9.

According to another embodiment the free end zone is necked forming the necked portion 17 which is subsequently provided with a precurl 18 and an elongated curl 19 thereby forming the container 1.

FIGS. 3-8 show in detail the deep drawing operation for the forming of a drawn container preform.

Figure 3C:
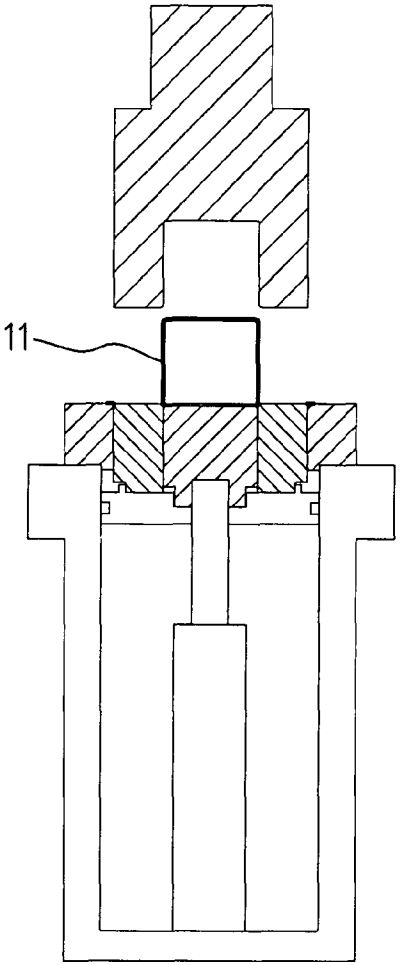
FIGS. 3A-3C show in cross-section and schematically the deep drawing operation starting from steel plate.
Figure 3B:
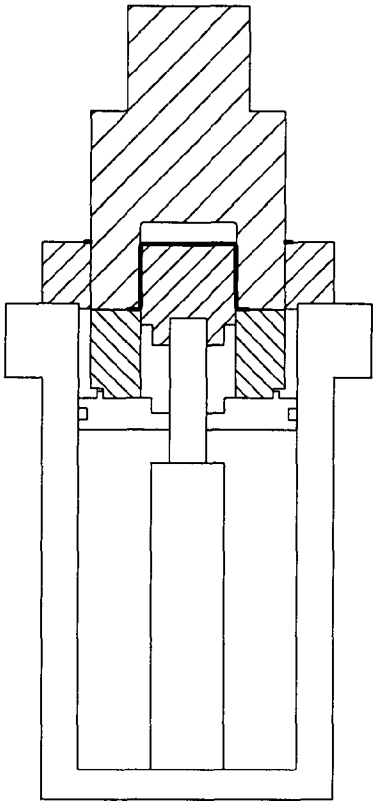
Figure 3A:
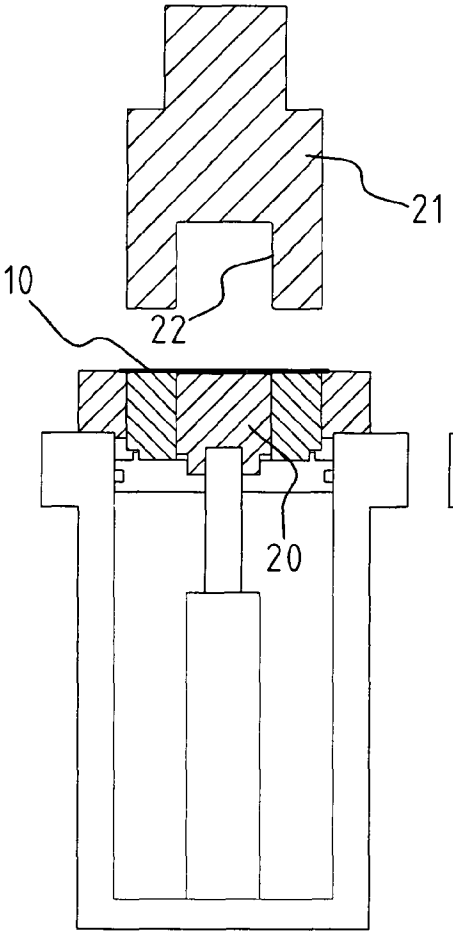

FIG. 3A shows a first deep drawing operation in which the steel plate 10 is formed into a cup 11. The steel plate 10 in the form of a circular disc is placed on a first deep drawing tool 20 cooperating with a deep drawing tool 21 provided with a forming cavity 22 into which the tool deep drawing tool 20 is pressed. The cup 11 formed has a diameter of 33 mm and a cup height of 32 mm (see FIG. 4).

Figures 5A, 5B, 5C, 6:
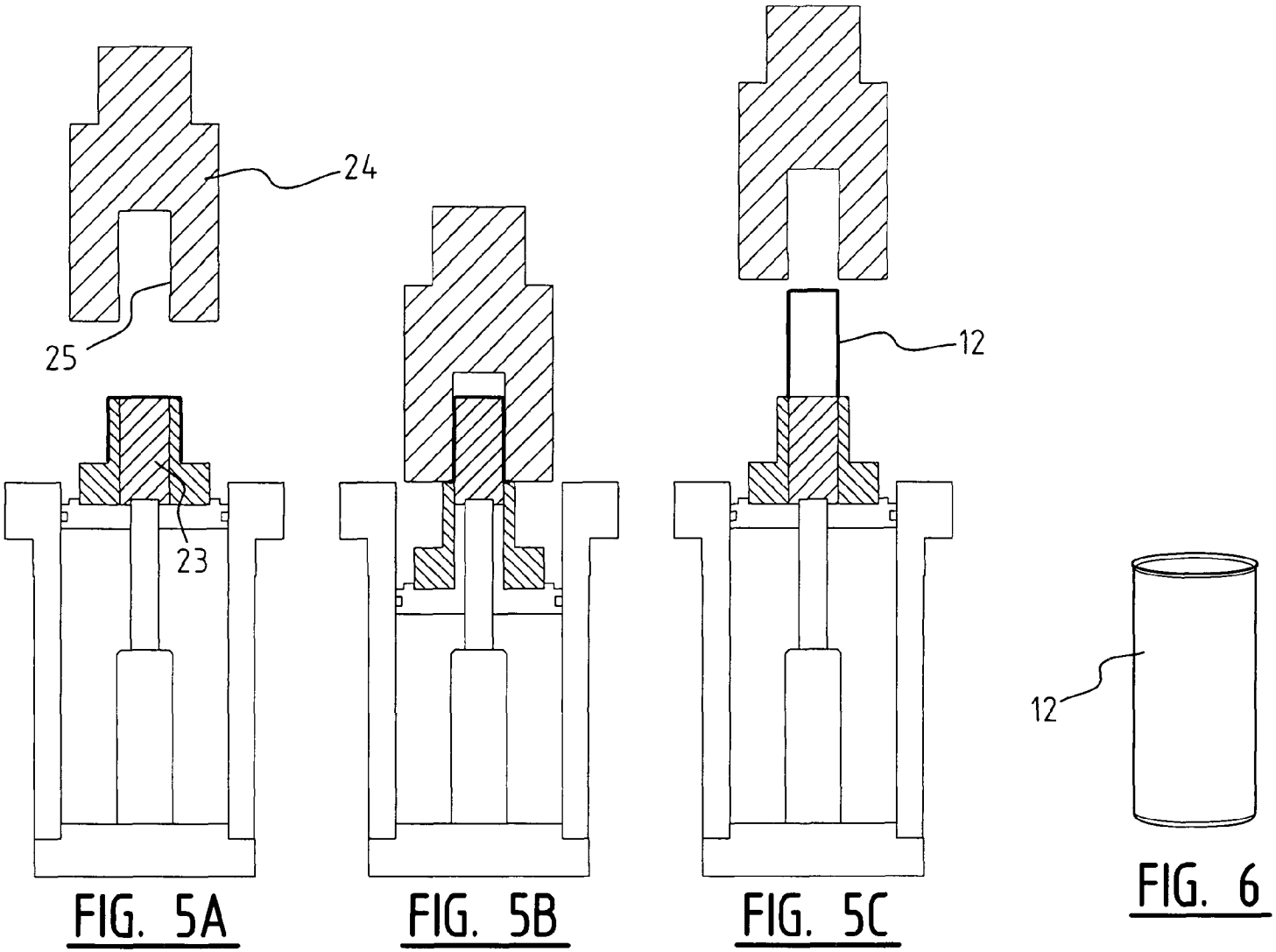
FIGS. 5A-5C show a second deep drawing operation.
FIG. 6 shows in perspective view the drawn container preform formed in FIG. 5C.
Figure 7A:
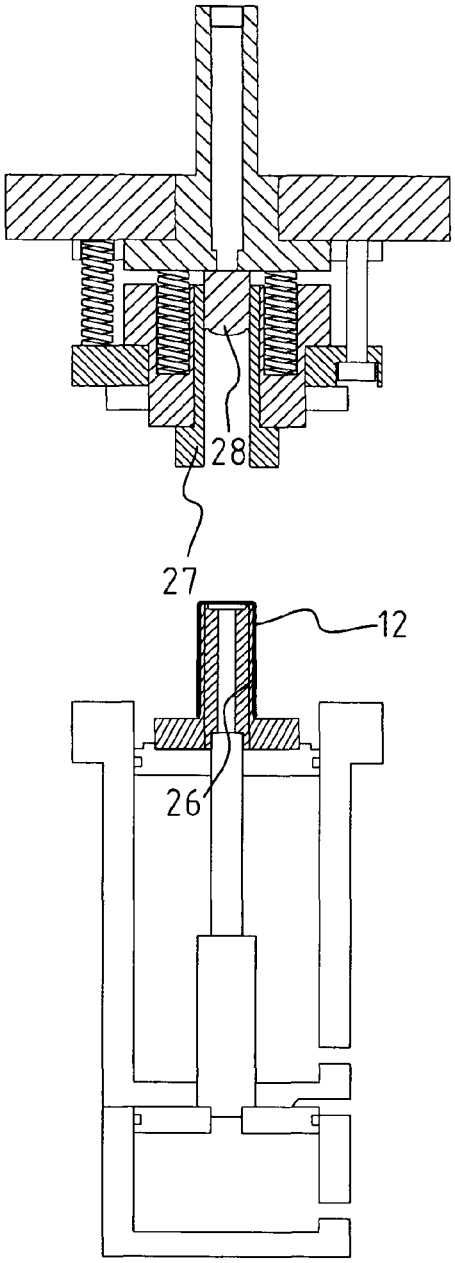
FIGS. 7A-7D show a third deep drawing step inclusive the formation of the concave container bottom.
Figure 7B:
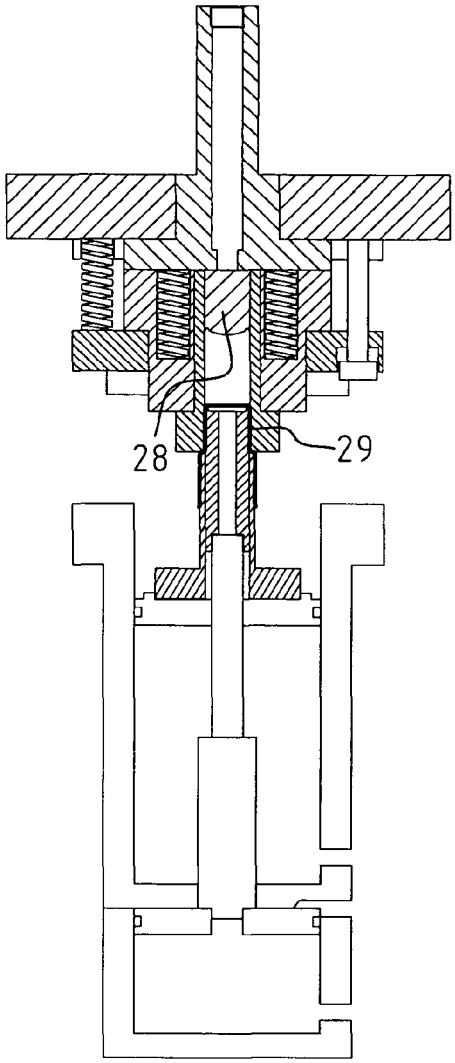
Figure 7C:
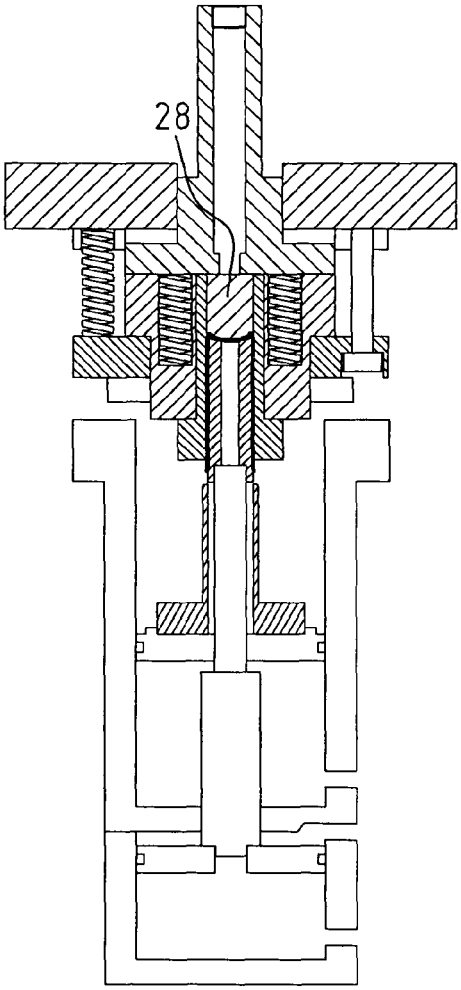
Figure 7D:
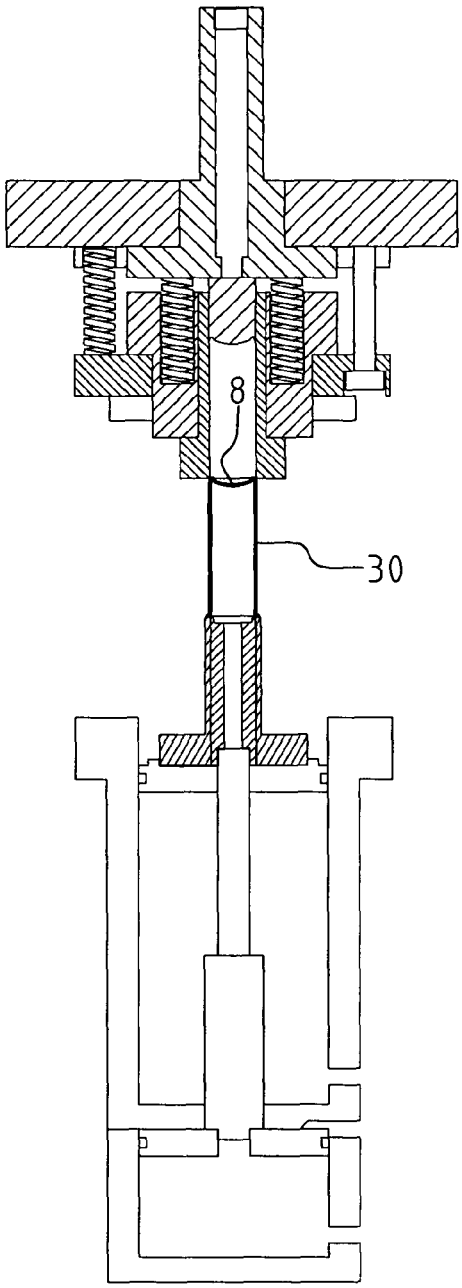

FIG. 5 shows a second deep drawing operation using a deep drawing tool 23 cooperating with an other deep drawing tool 24 provided with a cavity 25 into which the tool 23 is forced thereby forming the container preform 12 having a cup diameter of 27 mm and a cup height of 55 mm (see FIG. 6).

Figure 8:
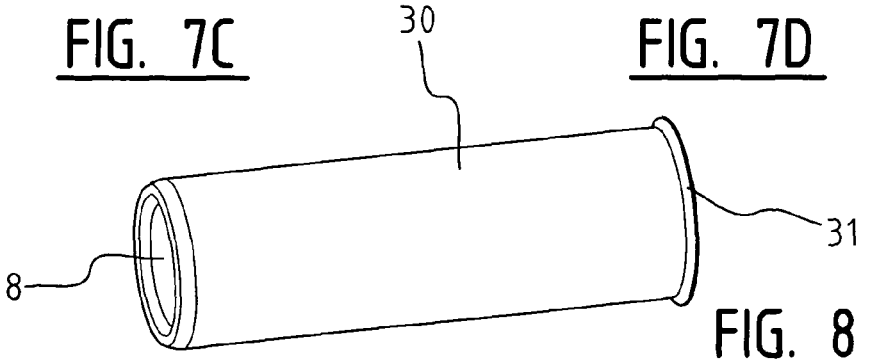
FIG. 8 shows in perspective view the drawn container preform formed in FIG. 7D.

FIG. 7 shows a third deep drawing operation in which the preform 12 of FIG. 6 is placed onto a deep drawing tool 26 which cooperates with a deep drawing tool 27 which is provided with a bottom forming tool 28. In FIG. 7B the deep drawing of the body of the preform 12 occurs until in FIG. 7C the preform is pressed against the tool 28 for forming the concave bottom. FIG. 7D shows the release of the preform 30 provided with the concave bottom 8. As shown in FIG. 8 this preform 30 has an edge 31. This preform 30 has a cup diameter of 22 mm and a cup height of 66 mm.

Figure 9C:
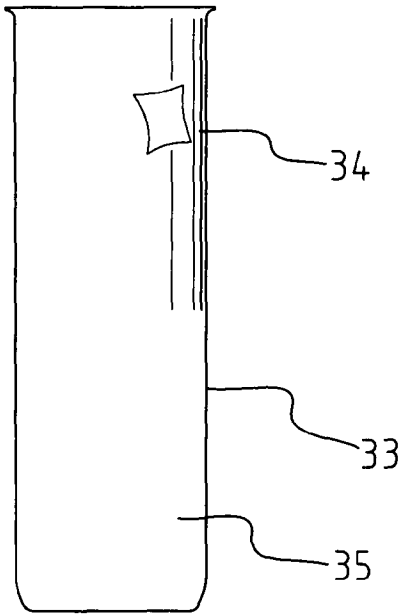
FIGS. 9A-9C show illustrating the heating treatment of the free body end of a drawn container preform according to the invention.
Figure 9B:
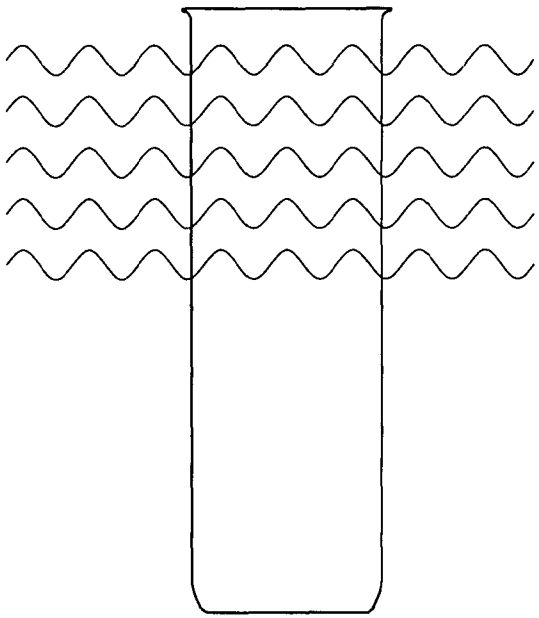
Figure 9A:
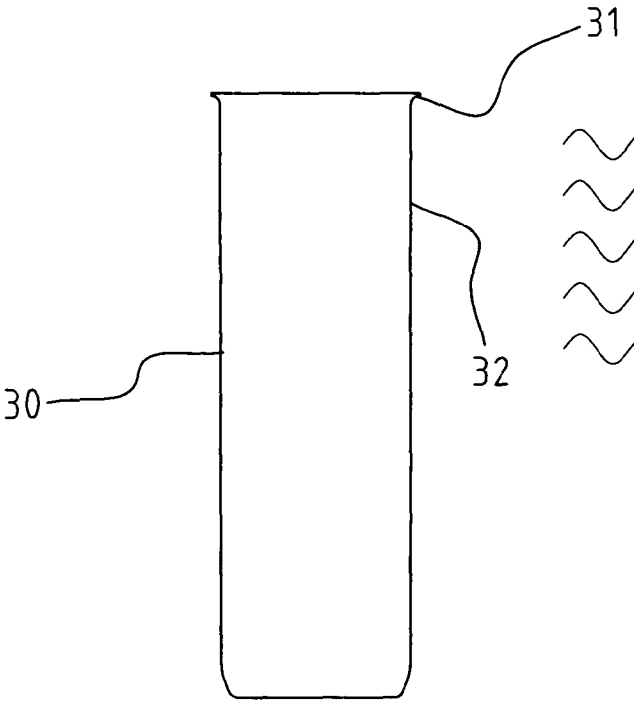

FIG. 9 shows a heating operation to which the preform 30 or 13 may be subjected at its free end zone 32. Due to the induction heating the heated preform 33 acquires a glossy end zone 34 and a non-glossy bottom zone 35 due to this heating treatment the coating of the steel the strengths at which the coating adheres to the steel is improved. It is noted that this heating step may also be carried out after the thin drawing of the preform as discussed in relation to the FIGS. 10-12. If the preform is provided with concave bottom then it is preferred to heat the bottom part (80-120° C. for 20-60 seconds) for avoiding stretch cracking.

As noted here in before the preform obtained in the third deep drawing operation as discussed in FIG. 7 has a wall thickness near its bottom of about 0.23 mm and a wall thickness near its free end of about 0.25-0.26 mm. This difference in wall thickness is ironed out, particularly in the free end zone using the operation schematically illustrated in FIGS. 10 and 11.

Figure 10A:
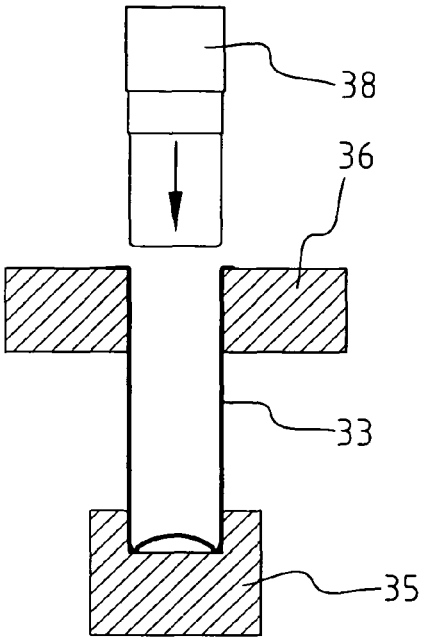
FIGS. 10A-10C show thin drawing step of the body of the drawn container preform and the trimming of the free edge.
Figure 10B:
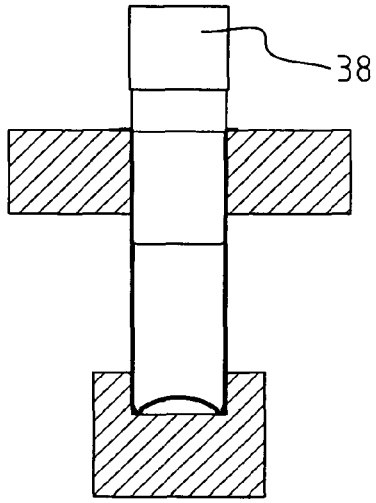
Figure 12:
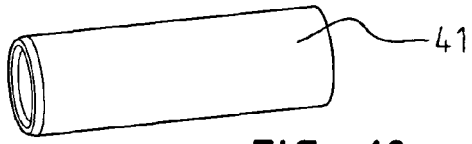

FIG. 10A shows the preform 33 which is placed in the tool parts 35 and 36. A thin drawing tool or stretching tool 38 is pressed into the preform 33 (see FIG. 10B), thereby ironing out the thickness of the body to a value of on average 0.22 mm. After removal of the stretching tool 38 the edge 31 of the deep drawn and thin drawn preform 39 is removed by cutting using a rotating cutting device 40. The trimmed drawn preform is then released and is shown in FIG. 12.

FIGS. 13A-13D show the subsequent first necking operation. This necking is carried out by so called mandril necking. The necking apparatus 42 shown in FIG. 13A comprises a clamping tool 43 which holds the preform 41. The clamp is connected to a base plate 44 carrying two levers 45. The short leg 46 of the lever 45 cooperates with a stud 47 placed on a table 54 and the longer leg 48 cooperates with a stud 49 supported by a stationary table 50. The support 44 is lowered towards a table 54 carrying a mandril 51 slidable in a support 53 which cooperates with the clamp 43 in which the preform 41 is clamped. The shorter legs 46 contact the studs 47 and the longer legs 48 contact the studs 49 (see FIG. 13B). Further downward movement of the support 44 according to the arrow 52 results in a downward movement of the mandril 51 relative to its support 53 in which the mandril 51 is slidably arranged while it is inserted in the preform 41.

Figure 13A:
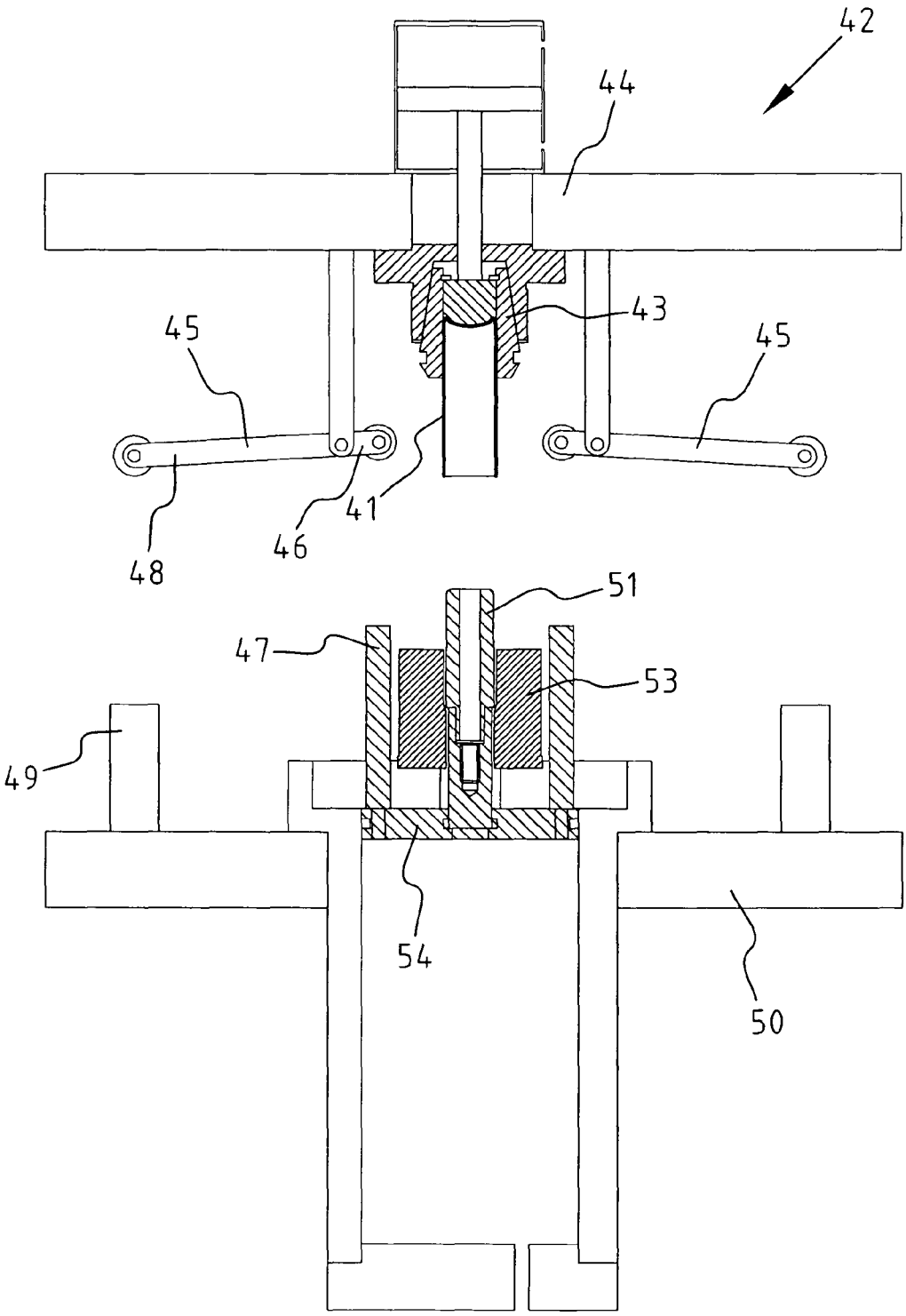
FIGS. 13A-13D show in cross-section and schematically a first necking operation by mandril necking.
Figure 13B:
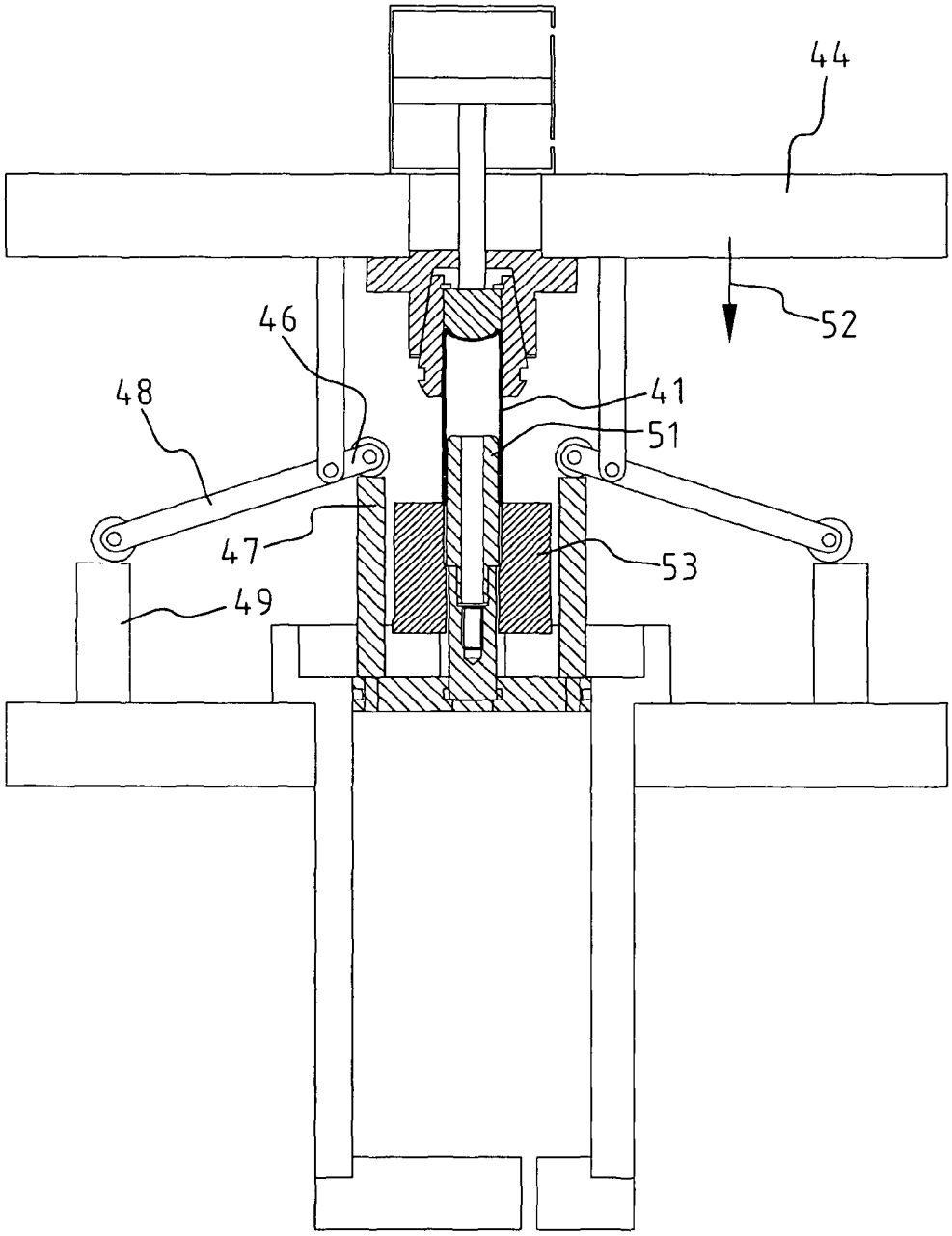
Figure 13C:
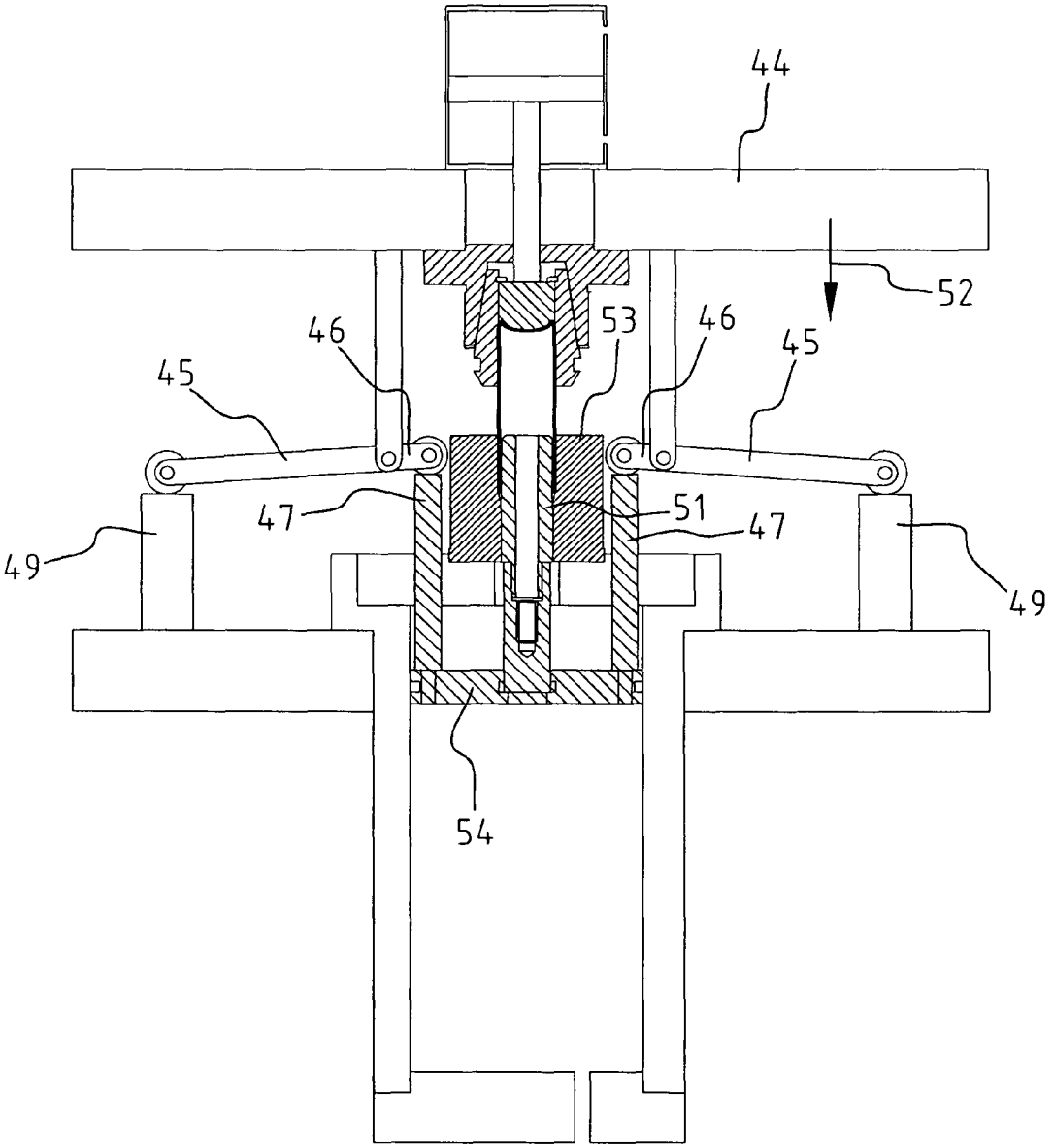
Figure 13D:
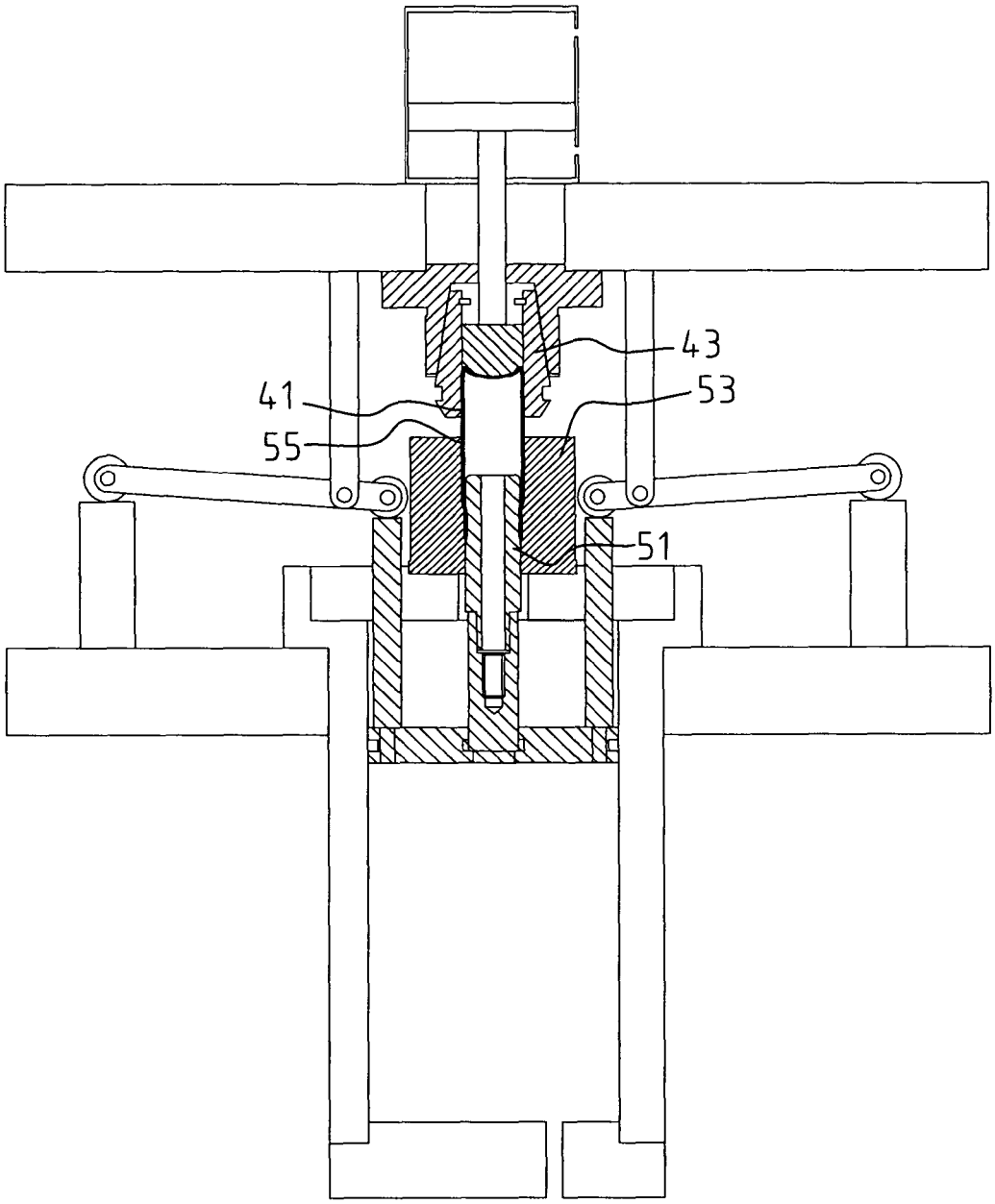
Figure 14A:
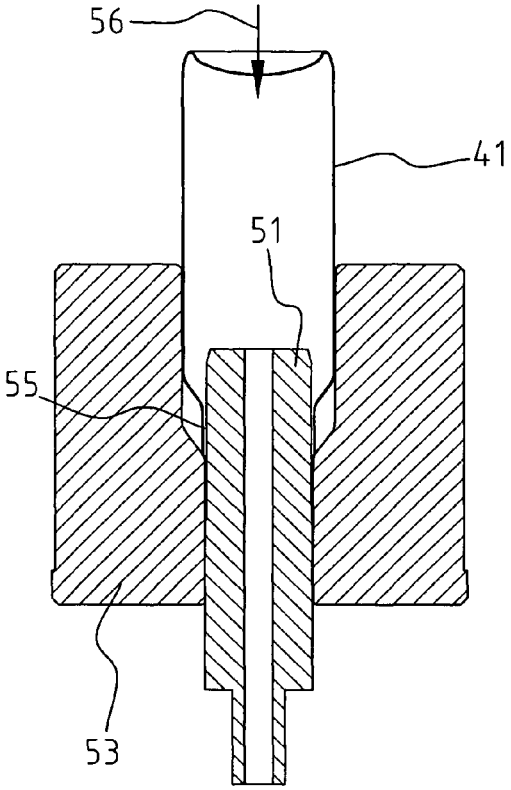
FIGS. 14A and 14B show a subsequent mandril necking operation.
Figure 14B:
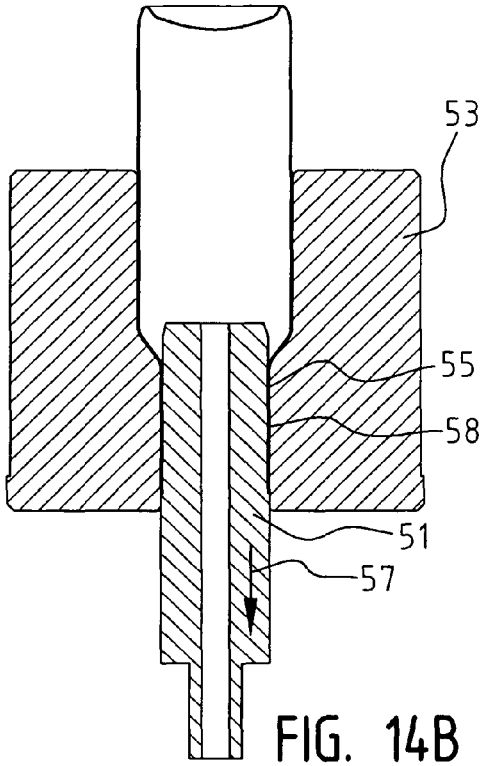

As shown in FIG. 13C the downward movement following arrow 52 of the support 44 results in a levering of both levers 45. This results in a retreat of the mandril 51 into its slide bearing support 53 while the studs 47 on the table 54 are further pressed downwardly by the levers 45 via the short legs 46 because the long legs support on the stationary studs 49. The final stage is shown in FIG. 13D. Here it is shown that the mandril 51 holds on it and presses against the slide bearing support 53 the free end zone 55 of the preform 41 clamped in the clamp 43. This situation is shown in more detail in FIG. 14A and FIG. 14B. The preform 41 is drawn following the arrow 56 with the mandril 51 inserted in the free end, into the slide bearing support 53 or forming tool. Effectively, the mandril 51 draws following the arrow 57 the free end zone 55 through the narrow opening 58 thereby forming the necked portion. The necking is thus carried out while the portion to be necked is inwardly supported onto a mandril 51 and drawn (instead of pushing) through the necking tool. Accordingly, the axial downward force is low. The necking results in a slight increase of the material thickness in the order of about 4%.

Progressively, the diameter of the necked free end zone may be reduced stepwise from about a diameter of 20 mm to a diameter of about 15 mm. These step wise reductions or necking operations may be carried out in 2-10 steps, in this case in 6 steps. Each necking step requires adapted tools for the clamp, the necking ring and the mandril.

The necked preform 59 is subsequently subjected to a cutting operation in which using a rotating cutting device 60 the free end is trimmed resulting in a sharp edge 61 in the necked portion 62 of the preform 63 (see FIGS. 15 and 16).

Figure 17:
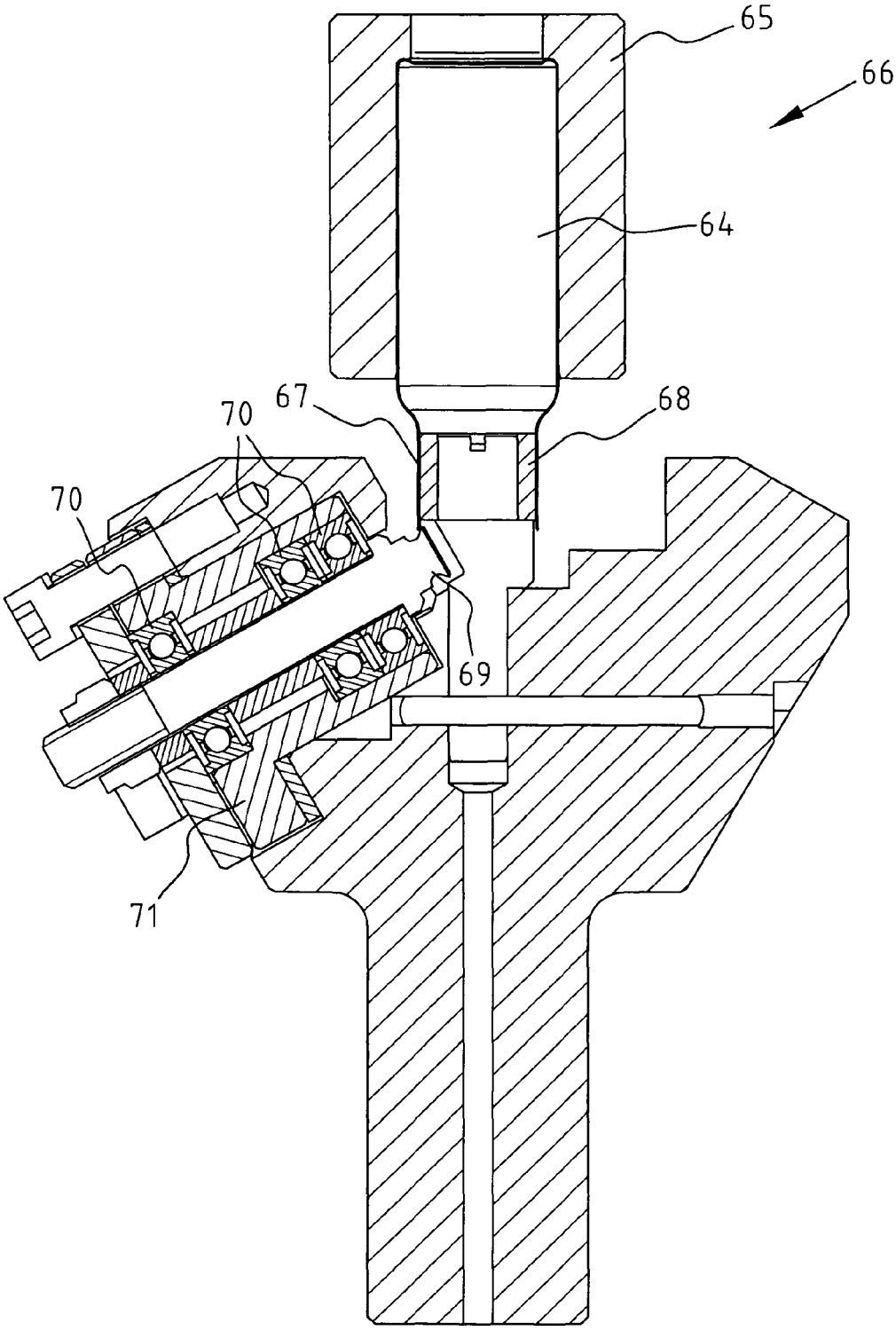
FIGS. 17 and 18 show the apparatus and various stages of the formation of the precurl.
Figure 18C:
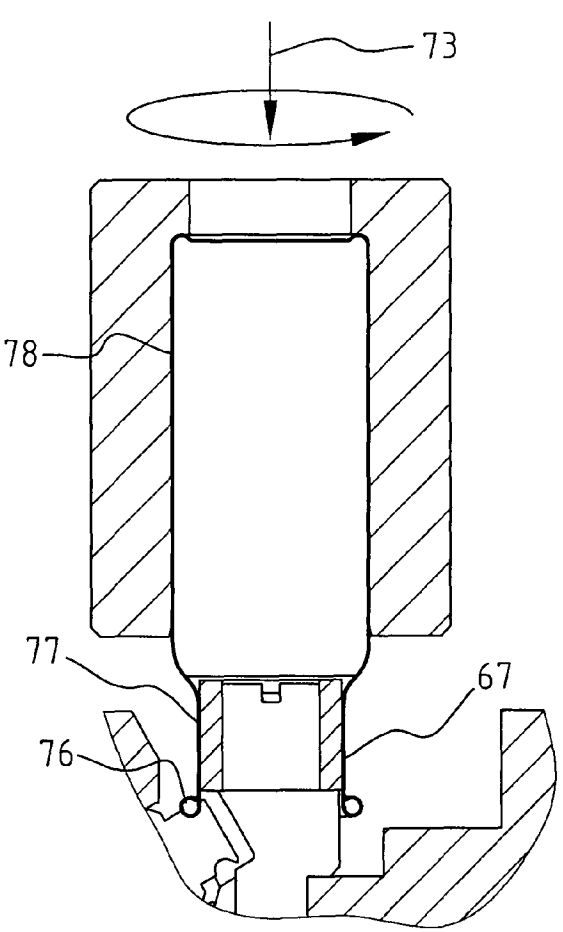
Figure 18B:
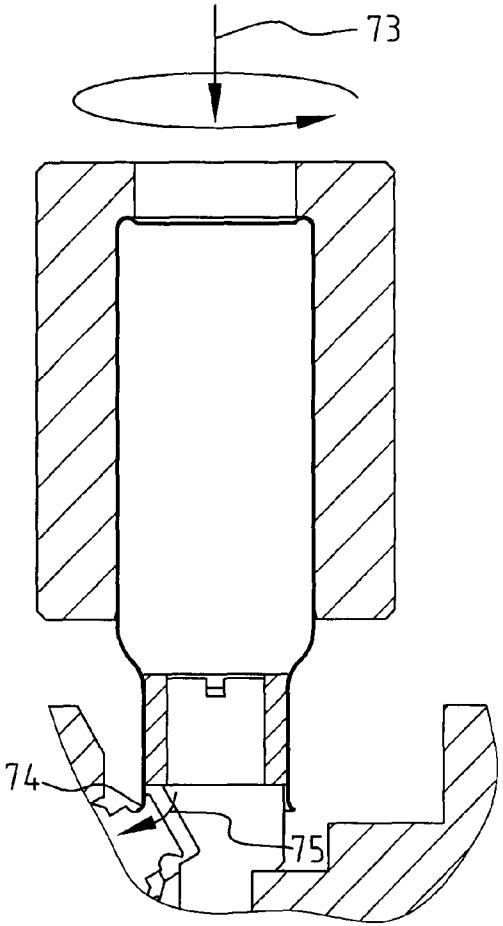

The FIGS. 17-19 show the curling operation for the open end of the container preform. FIGS. 17 and 18 show the formation of the pre-curl.

In FIG. 17 is shown a preform which is inserted into a holder 65 of the first curling apparatus 66.

The end zone 67 of the preform 64 is placed on a support 68 and brought into contact with a curling tool 69 which is rotably supported in bearings 70 in a holder 71.

Figure 18A:
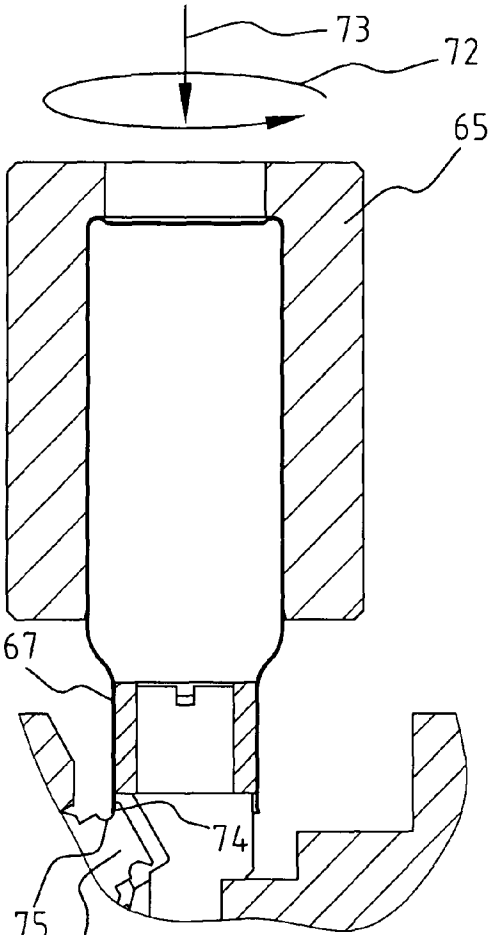

As shown in FIG. 18A the holder 65 is rotated according to the arrow 72 and moved downwardly according to the arrow 73. Thereby the free edge 74 of the end zone 67 contacts the curling tool 69 at its curling surface 75. This free end 74 is curled outwardly following the arrow 75 and due to the downward movement following the arrow 73 a precurl 76 is formed until the free end touched the outer surface 77 of the free end zone 67. Accordingly, is formed the preform 78.

Figures 19A, 19B, 19C:
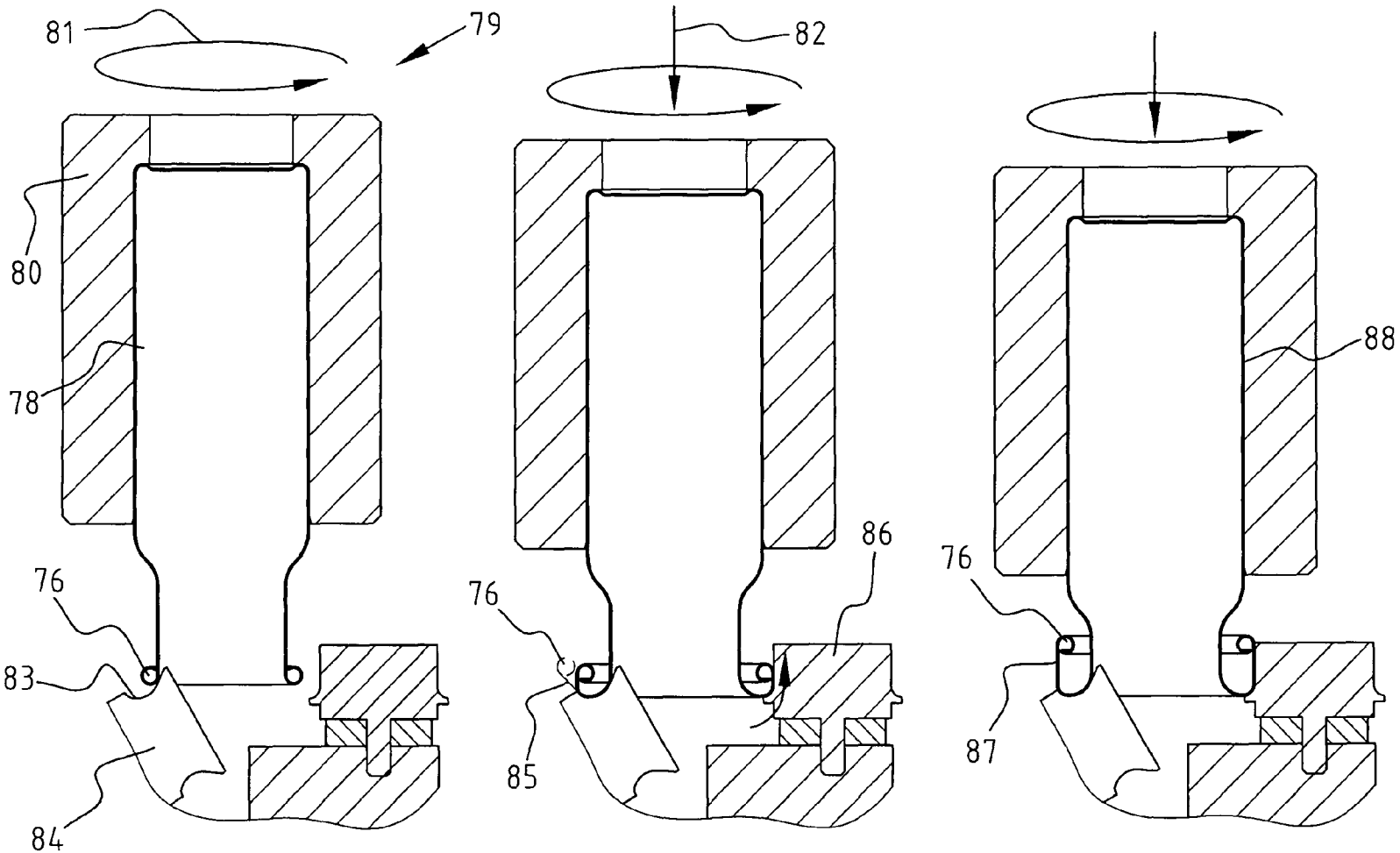
FIGS. 19A-19C show the second curling operation by curling the precurl into an elongated curl.
Figure 20:
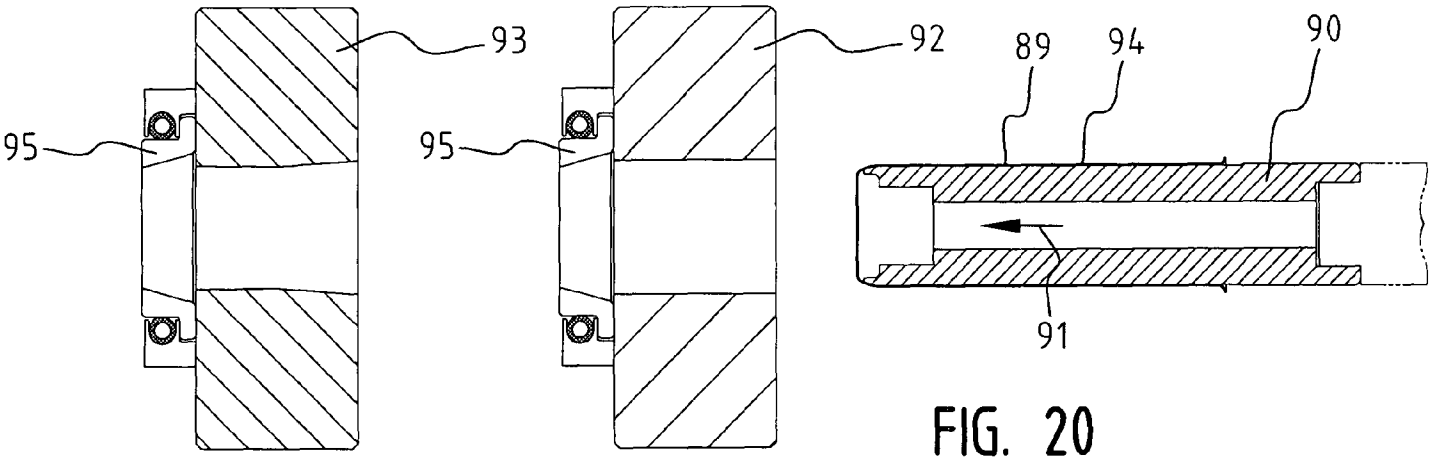
FIGS. 20-25 show another preferred embodiment of the thin drawing operation comprising pinch trimming.

As shown in FIG. 19 this preform 78 provided with the precurl 76 is subjected to a second curling operation in the curling apparatus 79. The curling apparatus 79 comprises a holder 80 in which the preform 78 is inserted. Subsequently, during the rotation following the arrow 81 and due to the downward movement following the arrow 82, the precurl is pushed against the curling surface 83 of a curling tool 84 thereby providing the end zone 85 already having the precurl 76 in addition with an additional elongated curl. This elongated curl moves radially outwardly but is pressed inwardly and radially following a forming role 86. Finally, as shown in FIG. 19C the elongated curl 87 is formed still comprising the precurl 76. Due to this form of tooling, dimensions and quality of the curl is substantially constant. Released from FIG. 19C is the steel container 88 as is shown in FIG. 1A.

Figure 10C:
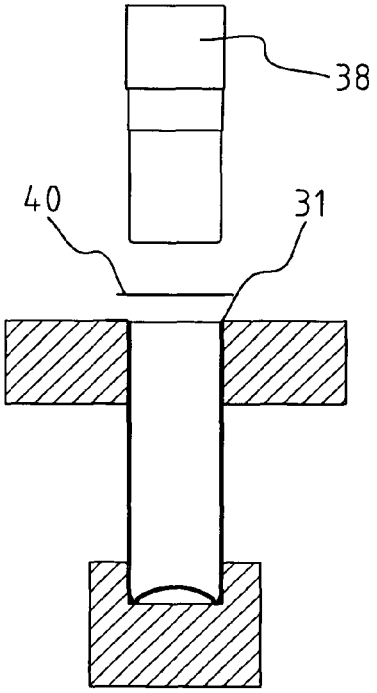
Figure 11:
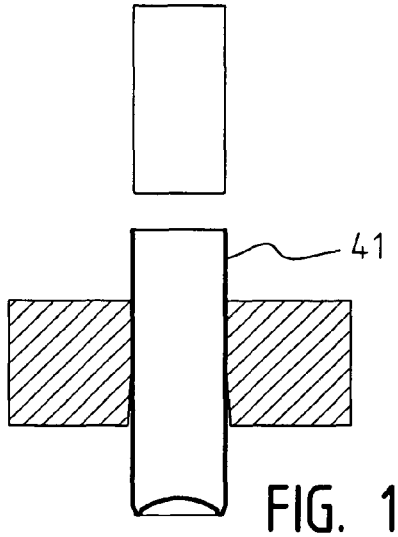
FIGS. 11 and 12 show the release and perspective view of the deep drawn, thin drawn and trimmed steel container preform.

FIGS. 20-27 show an alternative for the thin drawing and free end trimming of the drawn container preform as shown in FIGS. 10 and 11.

A preform 89 mounted on a punch 90 is passed following the arrow 91 through the thin drawing tools 92 and 93. During passage the body 94 of the preform 89 is thin drawn.

The preform also passes through the stripper rings 95 and 96.

Figure 21:
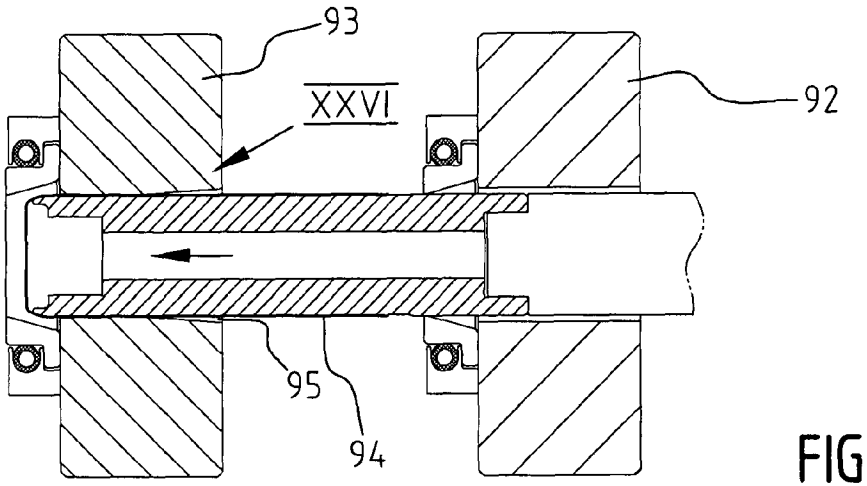
Figure 26:
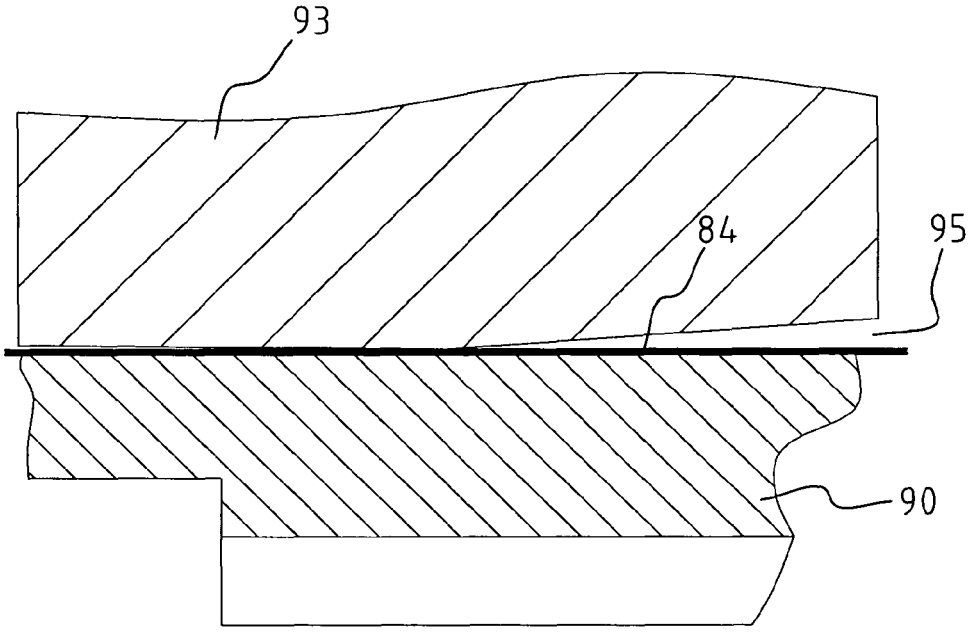
FIG. 26 is detail XXVI of FIG. 21.

FIG. 21 and in particular detail XXVI illustrated in FIG. 26 show the passage of the punch 90 through the tool 93. An annular opening 95 progressively decreases resulting in a thin drawing of the body 94.

Figure 22:
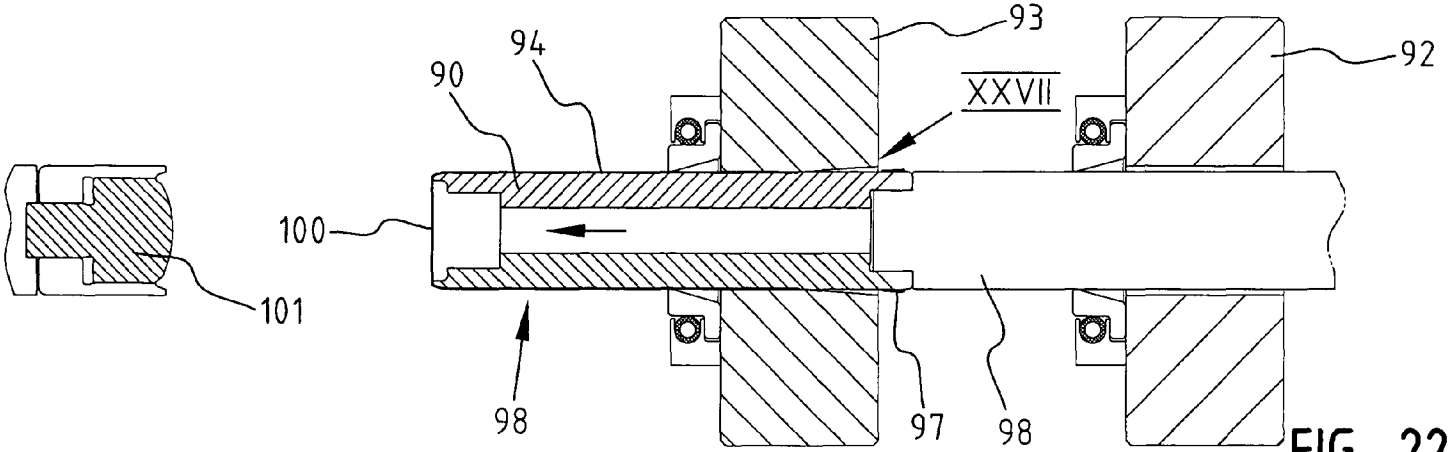
Figure 27:
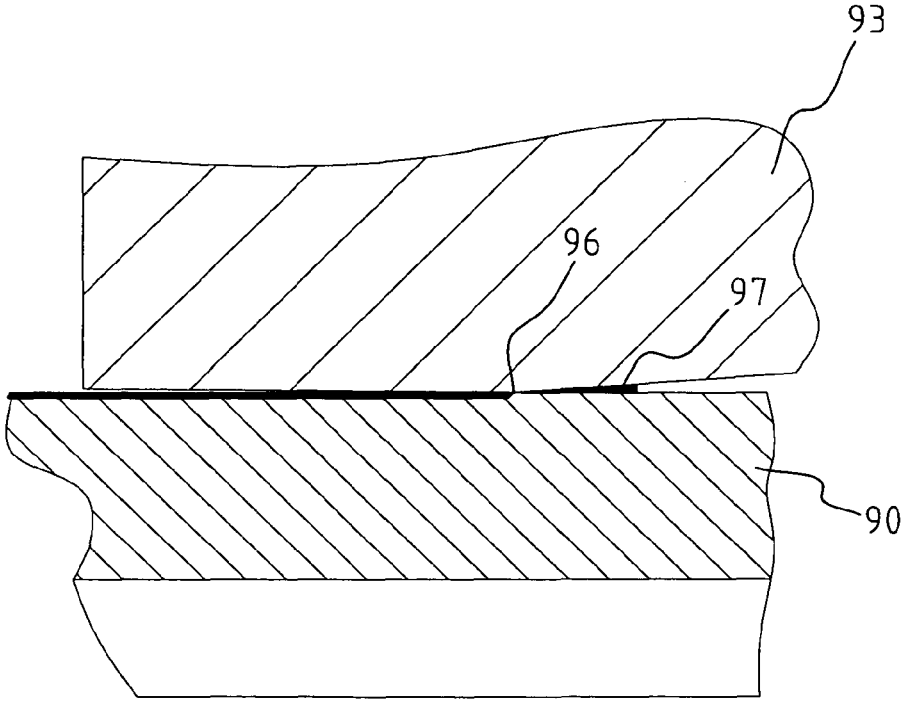
FIG. 27 is at larger skill detail XXVII of FIG. 22.

As shown in FIG. 22 and in particular in detail XXVII illustrated in FIG. 27, the punch 90 has a punch edge 96 of larger diameter such that the clearance between the tool 93 and the punch 90 is reduced to about 0.05 mm. This results in a trimming of a ring shaped end part 97 which remains upstream of the tool 93 slidably arranged on the punch and its piston 98 (see FIG. 22).

Figure 23:
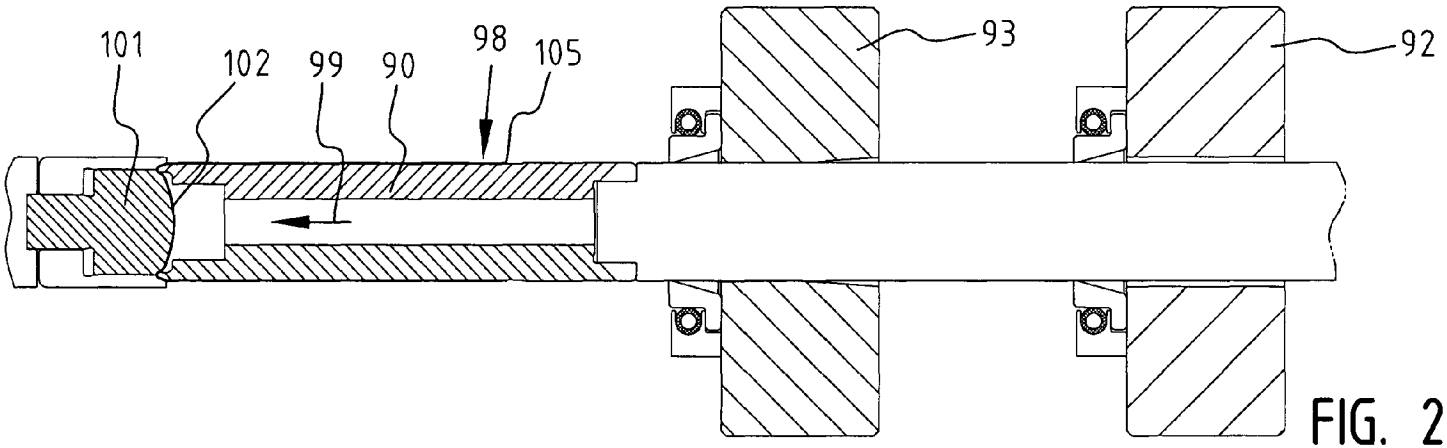
Figure 24:
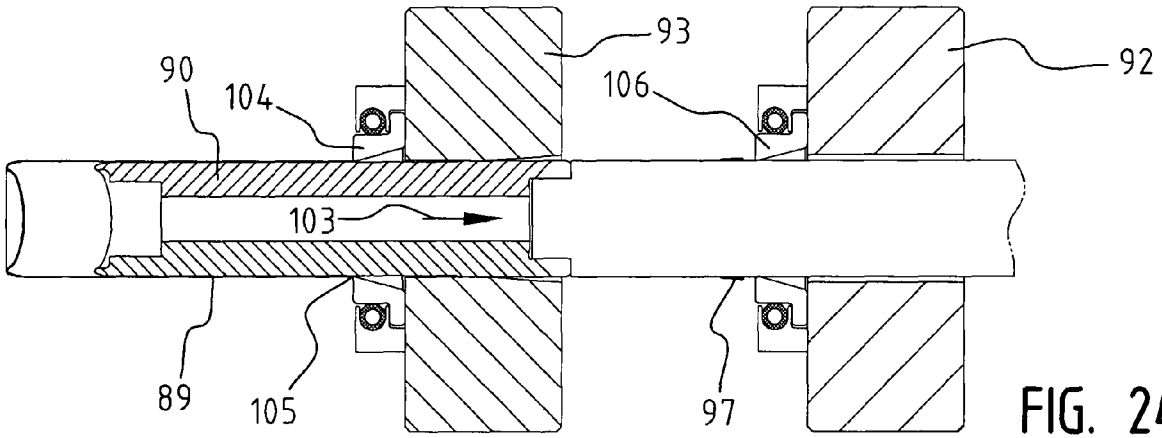
Figure 25:
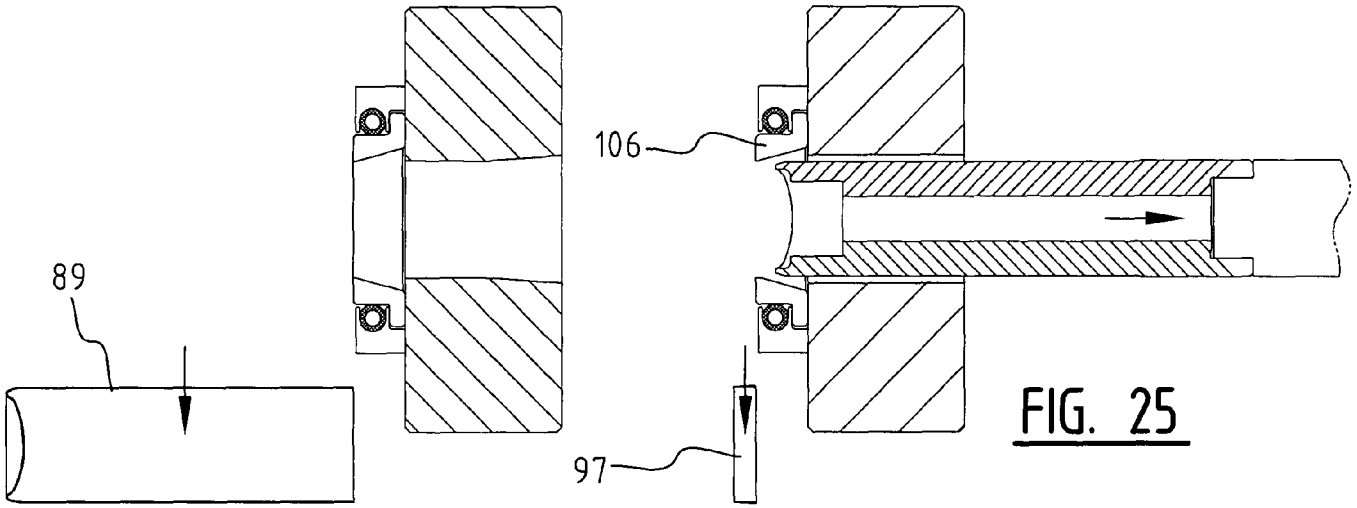

The punch 90 moves further following the arrow 99 until the bottom part 100 of the preform 89 contacts a tool 101 for forming the concave bottom form (see FIG. 23). Subsequently, the punch 90 is withdrawn following the arrow 103. However, a preform stripper 104 grips before the free end 105 of the preform 89 such that the preform 89 is stripped from the punch 90 while the punch 90 is withdrawn through the ring 93 according to the arrow 103 (see FIG. 24). In this manner the preform 89 is released. In a similar manner a trimmed ring stripper 106 retains in front of the trim stripper 106 the trimmed and annular ring 97. When the punch has been retreated beyond the trim stripper 106, then the trimmed off ring 97 is released and collected.

Figure 15:
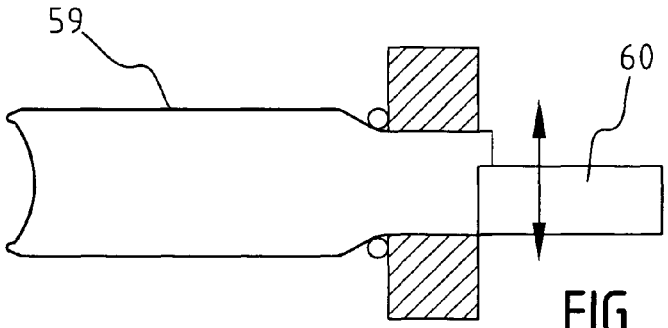
FIGS. 15 and 16 illustrate the cutting operation after necking and the formed necked container preform.
Figure 16:
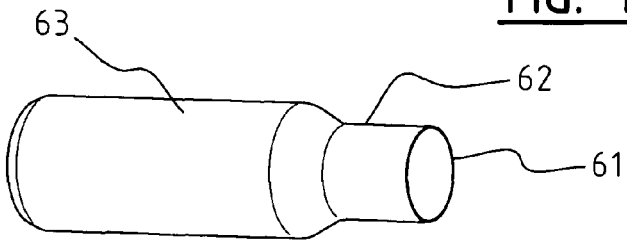
Figure 28:
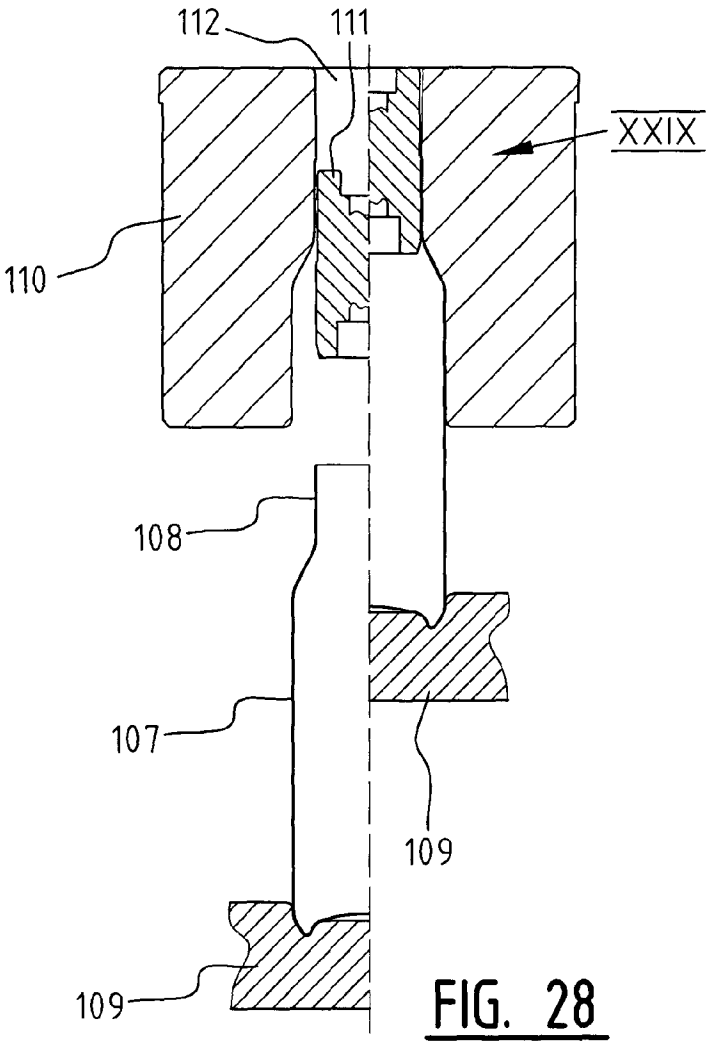
FIG. 28 shows in an alternative the pinch trimming operation during a last necking operation, and FIG. 29 at a larger scale detail XXIX in FIG. 28.

FIG. 28 shows an alternative for the trimming operation as disclosed in FIGS. 15 and 16. The preform 107 is trimmed at its necked free end 108 in a final necking operation.

The left cross sectional part of FIG. 28 shows the preform 107 supported on a support 109. This support 109 moves relative to a necking ring 110 and a mandril 111. The inner diameter of the necked free end 108 is such that the mandril 111 could be moved into the preform 107.

During the subsequent relative movement in between the support 109, the necking ring 110 and the mandril 111 (see also FIGS. 14A and FIG. 14B) the necked free end 108 supported on the mandril 111 is drawn through the necking opening 112.

Figure 29:
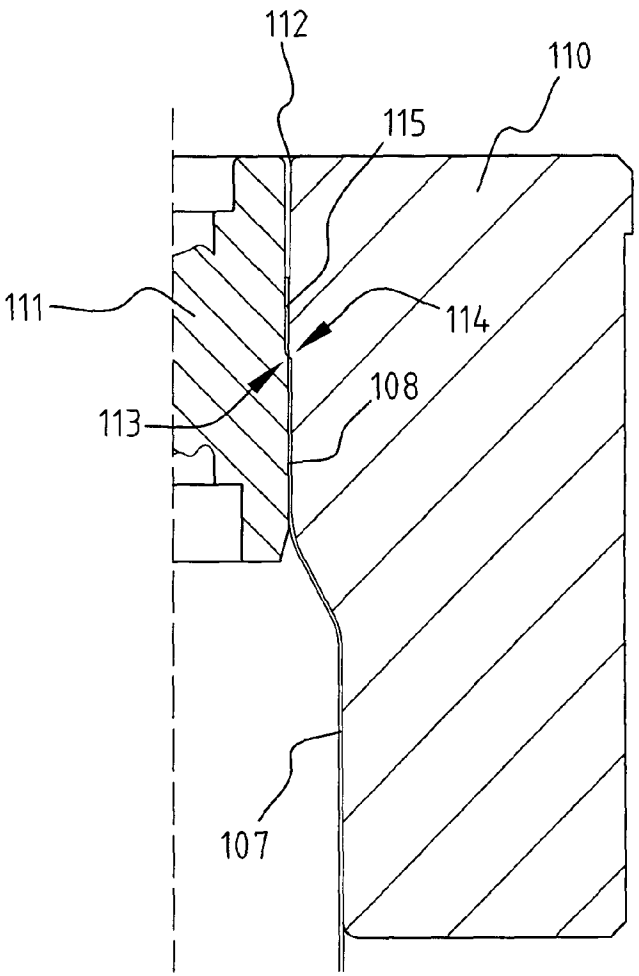

As shown in greater detail in FIG. 29 the mandril 111 is provided with a step 113 which corresponds with a similar step 114 in the opening 112 of the necking ring 110. This results in a pinching of a part 115 of the free end 108 thereby trimming the preform 107.

Thus, according to this embodiment the trimming of the preform and the final necking operation could be carried out in one and the same unit and during one and the same operation.

According to the various embodiments is produced a steel container having a curled open end which fulfils the objectives in relation to dimension stability, ease of production and of sufficient strength that a tight closure can be formed by clinching a closure or a dispensing unit. Furthermore, the steel may be coated at one or both sides in order to provide the steel with improved properties such as corrosion properties or other aesthetic properties. Still, a steel sheet laminate coated at one or both sides may be used and these coatings are still present in the steel container produced.

Furthermore, it is noted that the various operations used in the method of forming the steel container according to the invention and the various units used in the apparatus for forming a steel container according to the invention may be implemented in one and the same apparatus in which the preforms are circulated through the various units for being subjected to the various operations. On the other hand the same steel container may be produced using various apparatuses for carrying out the operations as defined in the claims of the present patent.

The invention claimed is:

1. A method for forming a steel container having a curled open end, comprising the steps of:

i) providing a steel cup;

ii) deep drawing the steel cup into a drawn container preform;

iii) drawing and ironing the body of the drawn container preform; and iv) curling an open end of the drawn container preform by forming a precurl and by curling the precurl into an elongated curl, wherein the method further includes a step of pinch trimming a free end of the drawn container preform, and wherein the pinch trimming step comprises:

engaging the free end of the drawn container preform with an inner tool, an outer tool, and at least one stepped edge provided on at least one of the inner tool and the outer tool;

moving the free end of the drawn container preform and the inner tool relative to the outer tool such that a portion of the free end of the drawn container preform is pinched between the inner tool and the outer tool at the at least one stepped edge; and removing the pinched portion from the drawn container preform, wherein the inner tool is a punch and the at least one stepped edge is provided on the punch.

2. The method as claimed in claim 1, wherein the steel cup is provided by forming from steel plate.

3. The method as claimed in claim 1, wherein the deep drawing step ii) comprises several deep drawing steps.

4. The method as claimed in claim 1, wherein the container preform is provided with a concave bottom form during or after the deep drawing step ii).

5. The method as claimed in claim 1, wherein the method further comprises a step of necking the free end of the drawn container preform.

6. The method as claimed in claim 5, wherein the necking step includes mandril necking.

7. The method as claimed in claim 1, wherein the steel is coated at least one side with a coating.

8. The method as claimed in claim 7, wherein at least the free end zone to be necked, is subjected to a heating treatment.

9. The method as claimed in claim 8, wherein the heating treatment comprises induction heating.

10. A method for forming a steel container having a curled open end, comprising the steps of:

i) providing a steel cup;

ii) deep drawing the steel cup into a drawn container preform;

iii) drawing and ironing the body of the drawn frawn container preform; and iv) curling an open end of the drawn container preform by forming a precurl and by curling the precurl into an elongated curl, wherein the method further includes a step of pinch trimmimng a free end of the drawn container preform, and wherein the pinch trimming step comprises:

engaging the free end of the drawn container preform with an inner tool, an outer tool, and at least one stepped edge provided on at least one of the inner tool and the outer tool;

moving the free end of the drawn container preform and the inner tool relative to the outer tool such that a portion of the free end of the drawn container preform is pinched between the inner tool and the outer tool at the at least one stepped edge; and removing the pinched portion from the drawn container preform, wherein the method further comprises a step of necking the free end of the drawn container preform, wherein the necking step includes a step of mandril necking, and wherein the pinch trimming step is performed at the same time as the mandril necking step and the mandril necking step also includes moving the drawn container preform and the inner tool relative to the outer tool.

11. The method as claimed in claim 10, wherein the inner tool is a mandril, the outer tool is a necking ring, and the at least one stepped edge includes at least one stepped edge provided on the mandril.

12. The method as claimed in claim 11, wherein the at least one stepped edge further includes at least one stepped edge provided on the necking ring and the at least one stepped edge on the mandril cooperates with the at least one stepped edge on the necking ring to form the pinched portion.

13. An apparatus for forming a steel container, comprising:

i) a unit for deep drawing a steel cup into a drawn container preform;

ii) a unit for thin drawing the body of the drawn container preform; and iii) a unit for curling an open end of the drawn container preform, which curling unit comprises a precurl forming sub unit and an elongated curl forming sub unit, wherein the apparatus further comprises a trimming unit for pinch trimming a free end of the drawn container preform, wherein the trimming unit comprises an inner tool, an outer tool, and at least one stepped edge provided on at least one of the inner tool and the outer tool, and wherein the inner tool, the outer tool, and the at least one stepped edge engage the free end of the drawn container preform such that moving the free end of the drawn container preform and the inner tool relative to the outer tool causes a portion of the free end of the drawn container preform to be pinched between the inner tool and the outer tool at the at least one stepped edge, wherein the inner tool is a punch and the at least one stepped edge is provided on the punch.

14. The apparatus according to claim 13, further comprising a unit for forming the steel cup from steel plate.

15. The apparatus according to claim 13, wherein the deep drawing unit comprises several deep drawing sub units.

16. The apparatus according to claim 13, further comprising a unit for forming a concave bottom in the container preform.

17. The apparatus according to claim 13, further comprising a necking unit for necking the free end of the drawn container preform.

18. The apparatus according to claim 17, wherein the necking unit comprises a mandril necking unit.

19. The apparatus according to claim 13, further comprising a heating unit for heating at least the free end zone to be necked.

20. The apparatus according to claim 19, wherein the heating unit comprises an induction heating unit.

21. An apparatus for forming a steel container, comprising:

i) a unit for deep drawing a steel cup into a drawn container preform;

ii) a unit for thin drawing the body of the drawn container preform; and iii) a unit for curling an open end of the drawn container preform, which curling unit comprises a precurl forming sub unit and an elongated curl forming sub unit, wherein the apparatus further comprises a trimming unit for pinch trimming a free end of the drawn container preform, wherein the trimming unit comprises an inner tool, an outer tool, and at least one stepped edge provided on at least one of the inner tool and the outer tool, and wherein the inner tool, the outer tool, and the at least one stepped edge engage the free end of the drawn container eform such that moving the free end of the drawn container preform and the inner tool relative to the outer tool causes a portion of the free end of the drawn container preform to be pinched between the inner tool and the outer tool at the at least one stepped edge, wherein the apparatus further comprises a necking unit for necking the free end of the drawn container preform, wherein the necking unit comprises a mandril necking unit, and wherein the mandril necking unit includes the inner tool and the outer tool of the trimming unit.

22. The apparatus according to claim 21, wherein the inner tool is a mandril, the outer tool is a necking ring, and the at least one stepped edge includes at least one stepped edge provided on the mandril, 23. The apparatus according to claim 22, wherein the at least one stepped edge further includes at least one stepped edge provided on the necking ring and the at least one stepped edge on the mandril is configured to cooperate with the at least one stepped edge on the necking ring to form the pinched portion.

* * * * *

UNITED STATES PATENT AND TRADEMARK OFFICE

CERTIFICATE OF CORRECTION

PATENT NO. : 8,844,334 B2
APPLICATION NO. : 12/375093
DATED : September 30, 2014
INVENTOR(S) : Johan Willem Roeterdink It is certified that error appears in the above-identified patent and that said Letters Patent is hereby corrected as shown below:

On the Title Page, Column 2, Item (57) Abstract, Line 2, delete "of" and insert -- of: --

In the Claims

Column 9, Line 17, Claim 10, after "drawn" delete "frawn"

Column 9, Lines 22-23, Claim 10, delete "trimmimng" and insert -- trimming --

Column 10, Line 45, Claim 21, delete "eform" and insert -- preform --

Signed and Sealed this
Third Day of February, 2015

Michelle K. Lee

Michelle K. Lee
*Deputy Director of the United States Patent and Trademark Office*